US006684738B2

(12) United States Patent
Huang

(10) Patent No.: US 6,684,738 B2
(45) Date of Patent: Feb. 3, 2004

(54) HANDLE FOR SOCKET WRENCH

(76) Inventor: Chin-chen Huang, 12, 41st Road, Industrial Zone, Shitun District, Taichung (TW)

( * ) Notice: Subject to any disclaimer, the term of this patent is extended or adjusted under 35 U.S.C. 154(b) by 0 days.

(21) Appl. No.: 10/076,314

(22) Filed: Feb. 19, 2002

(65) Prior Publication Data

US 2003/0154825 A1 Aug. 21, 2003

(51) Int. Cl.[7] ..... B25B 13/46
(52) U.S. Cl. ..... 81/60; 81/58; 81/177.4
(58) Field of Search ..... 81/57, 57.29, 58, 81/60, 177.4, 489, 490, 492

(56) References Cited

U.S. PATENT DOCUMENTS 542,317 A * 7/1895 Shea ..... 81/57
1,301,472 A * 4/1919 Macecevic ..... 81/57
2,529,476 A * 11/1950 Albertson ..... 74/157
2,570,706 A * 10/1951 Peluse ..... 81/57.26
2,938,415 A * 5/1960 Kostka ..... 81/57
4,253,356 A * 3/1981 Martinmaas ..... 81/177.4
4,302,990 A * 12/1981 Chrichton et al. ..... 81/60
4,318,314 A * 3/1982 Furedi et al. ..... 81/57.29
4,352,307 A * 10/1982 Martinmaas ..... 81/177.4
4,406,184 A * 9/1983 Cockman, Jr. ..... 81/57.29
4,449,559 A * 5/1984 Martinmaas ..... 81/177.4
4,474,089 A * 10/1984 Scott ..... 81/57.29
4,510,825 A * 4/1985 Neron et al. ..... 81/57.29
4,532,832 A * 8/1985 Christensen ..... 81/57.29
4,627,315 A * 12/1986 Lin ..... 81/177.4
4,699,028 A * 10/1987 Bosque ..... 81/57.22
4,907,476 A * 3/1990 Singleton ..... 81/57.29
4,960,016 A * 10/1990 Seals ..... 81/177.4
5,421,225 A * 6/1995 Chen ..... 81/490
5,887,493 A * 3/1999 Main ..... 81/57.29
6,070,499 A * 6/2000 Wisbey ..... 81/57.29
6,199,454 B1 * 3/2001 Bergbower ..... 81/60
6,311,584 B1 * 11/2001 Chu ..... 81/57.29
6,349,623 B1 * 2/2002 Peters ..... 81/177.4
6,457,386 B1 * 10/2002 Chiang ..... 81/62

* cited by examiner

*Primary Examiner*—Joseph J. Hail, III
*Assistant Examiner*—David B. Thomas
(74) *Attorney, Agent, or Firm*—Rabin & Berdo, P.C.

(57) ABSTRACT

A torque transfer mechanism for a socket wrench includes a handle and a turning shank that are integrally formed from the same metallic material. The turning shank is implanted in an annual slot disposed at a central part of the handle head in an effort to enhance rigid bending and the durability of the handle and the turning shank. The handle head contains a hollow chamber to receive a tubular socket wrench.

4 Claims, 2 Drawing Sheets

HANDLE FOR SOCKET WRENCH

FIELD OF THE INVENTION

This invention relates an improvement of the handle for the socket wrench, a continuation of my previous application of "An Improvement of Torque Transfer Mechanism for Socket Wrench".

BACKGROUND OF THE INVENTION

Generally, the prior art of socket wrench has an adequate length of handle extended horizontally from the handle head. The head provides a round hollow chamber for accommodating the torque head, a ratchet installed on the chamber wall and a pair of swivel brake block mounted on the sides of torque head for adjustment for right turning and left turning of the turning head. The brake blocks protrude outward on the torque head for easy adjustment and messing into the ratchet, so the torque is transferred out in right rotation or left rotation so to tighten or loosen the bolt. In fact, in the operation of the prior art of the socket wrench, the square torque head is the torque output point and the handle is the torque input point in which the torque output shall be vertically applied to the bolt at the square torque head and the torque input shall be applied at right angle from the handle. But in the reciprocated swing, it is very hard for the operator to keep the handle on a level; in order word, the swing usually results in an up and down oscillation. This oscillation produces unstable contact of the torque head with the bolt in the square recess as well as an unstabilized torque output. While the blot does not reach a depth to obtain an adequate holding force, and while the handle returns for the next turning, the bolt will follow the torque head to return simultaneously with no resistance. This is an obvious hardness encountered in the very beginning of bolt tightening operation. In other case, the longer the bolt shank the more difficult to be faced in maintaining the level swinging, verticality and accurate contact with the bolt. This shortfall incites a dislike when the consumers use the prior art of the socket wrench. It is necessary to carry out an improvement on the prior art of the socket wrench. The previous application of "An Improvement of Torque Transfer Mechanism for Socket Wrench" aims to surmount the foregoing shortfall prevailing on the prior art of socket wrench. Where the interior of the handle head is designed with a go-through cavity extended beyond the round chamber of the torque head, so the intersection is therefore formed an open chamber to receive a bevel gear. The handle and the turning shank are mould-formed integrally. An annual slot is built around the perimeter of the turning shank to receive the torque head end, permitting the pillar of the turning shank to stretch into the chamber and the bevel gear to move backward into the open chamber and to be locked firmly on the pillar. A ring gear is mounted in the groove of the chamber wall with well disposed retaining bead to fit on the torque head. When the torque head is being inserted into the chamber of the handle head, the ring gear and the bevel gear are messed perfectly and the bevel gear is always held in place. In the tightening operation, when the handle is reciprocated in swing, the bevel gear and the ring gear will transfer the torque output to the torque head, so the shortfall encountered in the prior art of the socket wrench is solved.

From careful observation, it is found that the handle and the turning shank as illustrated in the application of "An improvement of Torque Transfer Mechanism for Socket Wrench" are two independent members in which the turning shank is being inserted into the molded handle. To ensure a rigid and solid link of the turning shank with the handle, the insert of the turning shank must be deep enough. However, doing this would leave less room in the chamber to accommodate the torque head. For this reason, the inventor has made a great effort in the improvement of the handle.

SUMMARY OF THE INVENTION

The main object of the invention is to provide an improved handle for the socket wrench. The handle is integrally formed with the turning shank with same metallic material so the length of the turning shank is adequately shortened and sufficient room is reversed in the chamber to contain the torque head.

Another object of the invention is to provide an improved handle for the socket wrench in which the handle and the turning shank are integrated to enhance its rigidity and durability. The technical improvement, feature and performance are explained in great details with the aid of embodiments as illustrated in the attached drawings.

DETAILED DESCRIPTION OF THE INVENTION

Figure 1:
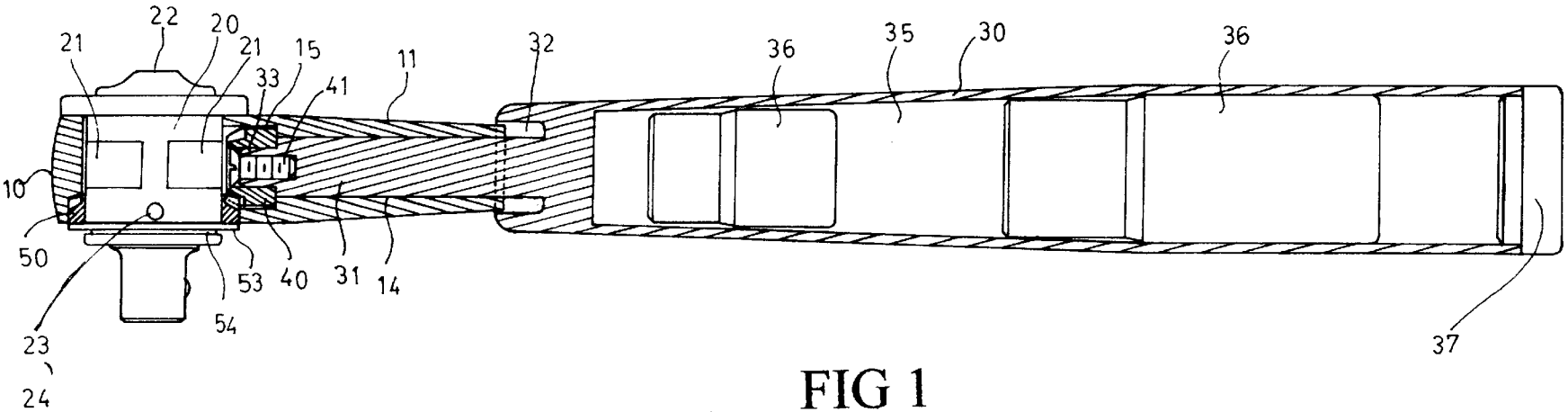
FIG. 1 shows a whole assembly of the socket wrench of the invention.
Figure 2:
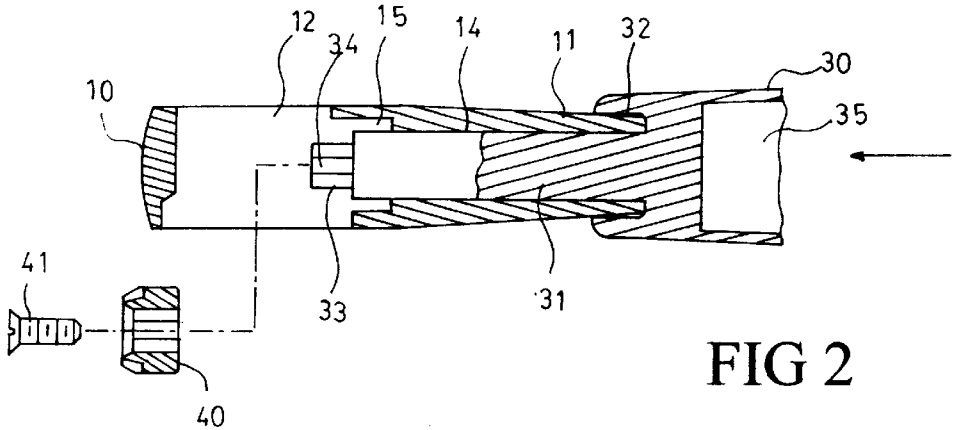
FIG. 2 shows a disassembly of the bevel gear system of the invention.
Figure 3:
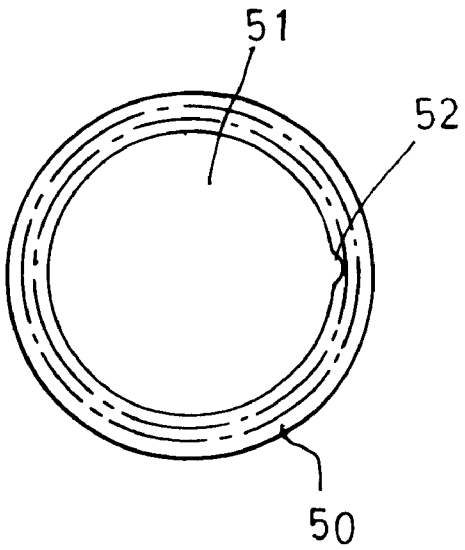
FIG. 3 shows an outlook if the ring gear mounted in the torque transfer mechanism of the invention.
Figure 4:
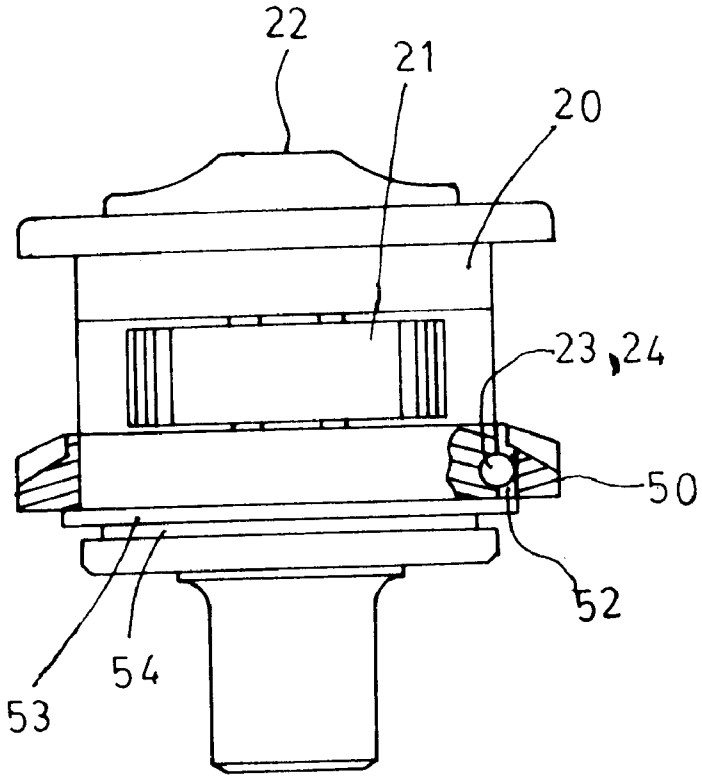
FIG. 4 is a schematic diagram showing combination of the ring gear the torque head of the invention.

As shown in the drawings, the construction and members of this invention are similar to the application of "An improvement of Torque Transfer Mechanism for Socket Wrench", in which the turning shank 31 of the handle 30 penetrates fully into the pivotal slotted trough 14 of the handle head end 11. An annular slot 32 is built in the handle 30 to receive the handle head end 11. The pillar 33 on the tip of the turning shank 31 extends into the chamber 12 of the handle head 10, conducive for the bevel gear 40 to be firmly locked on the pillar 33 and is drawn into the open chamber 15. The torque head 20 is contained in the chamber 12 of the handle head 10. The ring gear 50 comes from the bottom of chamber 12, sleeves onto the torque head 20 and fits in place by the retaining bead 24 between the cavity 23 and groove 52. A C clamp 53 is employed to hold the torque head 20 in the catch groove 54 so the torque head 20 is secured steadfast in the chamber 12 of the handle head 10. The ring gear 50 messes with the bevel 40 and restrains it in the open chamber 15 behind the chamber 12. In the reciprocated swing, the handle 30 performs double action, pivoting the swing and transferring the torque output.

The handle 30 and the turning shank 31 are integrally formed and an annular slot 32 is built on the perimeter of the turning shank 31. This improvement enhances the rigidity and durability of the handle 30 and the turning shank 31 as well. More room is reserved in the hollow chamber 35 of the handle 30 to store a variety of tubular socket wrenches 36 through the cap 37.

From the aforementioned statement, it is apparent that the improvement of handle described in this invention offers more practical value, usage and efficiency.

What is claimed is:

1. A socket wrench, comprising:

a handle and a turning shank collectively forming a one piece component, said handle having a hollow interior to store a variety of tubular socket wrenches therein; and a handle head having a cavity, said turning shank being insertable into the cavity of said handle head to connect said handle to said handle head;

wherein said turning shank is integrally connected to an end of said handle, said handle having an annular slot formed in the end, and which surrounds said turning shank, said handle head having an end that is received within the annular slot when said turning shank is inserted into the cavity, to connect said handle to said handle head.

2. The socket wrench defined in claim 1, wherein said handle head has a chamber formed therein; further comprising a torque head that is adapted to receive a selected one of the tubular socket wrenches, said torque head being received within the chamber.

3. The socket wrench defined in claim 2, further comprising a bevel gear attached to a free end of said turning shank, said torque head having a ring gear that meshes with said bevel gear.

4. The socket wrench defined in claim 3, wherein shank are formed from a common metallic material.

* * * * *